US006973769B2

(12) United States Patent
Meier

(10) Patent No.: US 6,973,769 B2
(45) Date of Patent: Dec. 13, 2005

(54) METHOD FOR CREATING MARKINGS ON A PLANAR TEXTILE BODY

(75) Inventor: Rudolf Meier, Uster (CH)

(73) Assignee: Uster Technologies AG, Uster (CH)

( * ) Notice: Subject to any disclaimer, the term of this patent is extended or adjusted under 35 U.S.C. 154(b) by 10 days.

(21) Appl. No.: 10/312,830

(22) PCT Filed: Jun. 29, 2001

(86) PCT No.: PCT/CH01/00408

§ 371 (c)(1),
(2), (4) Date: Apr. 1, 2003

(87) PCT Pub. No.: WO02/02855

PCT Pub. Date: Jan. 10, 2002

(65) Prior Publication Data

US 2003/0154706 A1 Aug. 21, 2003

(30) Foreign Application Priority Data

Jul. 6, 2000 (CH) ..... 1333/00

(51) Int. Cl.[7] ..... D02G 3/22; D03D 15/00
(52) U.S. Cl. ..... 57/210; 139/426 R
(58) Field of Search ..... 57/207, 212, 218–220; 139/426 R

(56) References Cited

U.S. PATENT DOCUMENTS

| | | | | | |
|---|---|---|---|---|---|
| 2,245,641 | A | * | 6/1941 | Bell et al. | 139/426 R |
| 3,780,512 | A | * | 12/1973 | Ratti | 57/16 |
| 4,302,926 | A | * | 12/1981 | Maixner et al. | 57/6 |
| 4,313,998 | A | * | 2/1982 | Pivot et al. | 428/222 |
| 4,523,425 | A | * | 6/1985 | Schild et al. | 57/212 |
| 4,663,927 | A | * | 5/1987 | Takemae et al. | 57/6 |
| 5,881,547 | A | * | 3/1999 | Chiou et al. | 57/216 |
| 5,927,060 | A | * | 7/1999 | Watson | 57/210 |

FOREIGN PATENT DOCUMENTS

| | | |
|---|---|---|
| FR | 2 124 550 | 9/1972 |
| WO | WO 95/14805 | 6/1995 |

* cited by examiner

*Primary Examiner*—John J. Calvert
*Assistant Examiner*—Shaun R. Hurley
(74) *Attorney, Agent, or Firm*—Buchanan Ingersoll PC

(57) ABSTRACT

A method for creating markings on a planar textile body and a thread-like body for carrying out the method. According to the invention, the markings on a planar textile body can survive all following process steps and permits a clear marking of position on the textile surface. During production of the planar body, a thread-like body is included, which comprises a support with a filament wound around the support. The support is divided into marked zones and mark-free zones.

6 Claims, 1 Drawing Sheet

METHOD FOR CREATING MARKINGS ON A PLANAR TEXTILE BODY

This disclosure is based upon Swiss Application No. 1333/00, filed on Jul. 6, 2000 and International Application No. PCT/CH01/00408, filed Jun. 29, 2001, the contents of which are incorporated herein by reference.

BACKGROUND OF THE INVENTION

The invention relates to a method for producing markings on a textile fabric and a thread-like structure used for this purpose.

A method for tracking textile product webs by a plurality of production steps is known from the individual conference report: "Textiltechnisches Seminar, Textile Messtechnik, (Textile Technology Seminar, Textile Measuring Method), ETH Zurich, St. Gallen, CH, Nov. 26, 1998, pages 1 to 4", wherein markings are incorporated into the product web, allowing relative determination of position. In the process, the markings are produced by incorporating at least partially electrically conductive yarn. For this purpose very flexible and break-resistant wire is used which, in portions, is spun with cotton into a yarn. The markings formed by the electrically conductive yarn portions are detected in a capacitor which determines the yarn portions by the changed capacity between the capacitor plates.

A drawback of this known method is that it is very difficult to spin short portions of wire of this type. This means that these portions inevitably comprise a certain length which leads to the markings produced in this way being indistinct and covering whole regions. Moreover, they can only be detected by a capacitor and this represents a limitation within today's current broader detection systems.

SUMMARY OF THE INVENTION

The invention, as characterised in the claims, therefore achieves the object of providing a method for producing markings on a textile fabric which survives all the following processing steps and allows clear marking of positions on the textile fabric.

This is achieved according to the invention in that according to the method, during production of the fabric, at least in one edge region, a thread-like structure is included, consisting of a support around which a filament is wound, the filament dividing the support into marking zones and marking-free zones. The filament in the marking zones preferably has, measured per unit of length, a high number of windings and, in the marking-free zones, a comparatively low number of windings. The winding around the support is produced by controlled fancy twisting of support and filament, the division into marking zones and marking-free zones taking place by control of the fancy yarn doubling frame used. The thread-like structure is included during production of the fabric preferably by weaving into the fabric. The filament consists of an electrically conductive wire, the diameter of which is smaller than the diameter of the support and in the marking zones it substantially forms mutually adjacent windings on the support. In the textile fabric, in at least one edge region, a thread-like structure is provided, consisting of a support around which a filament is wound and which divides the support into marking zones and marking-free zones. In a woven fabric the thread-like structure is preferably woven into the central region of the so-called edge.

The advantages achieved by the invention are in particular that a method is provided with which faults in the textile fabric, for example, can be indicated by a position reference which can be traced back even after a plurality of processing steps. Processing steps of this type are known, for example, by names such as scorching, desizing, mercerising, bleaching, washing, drying, etc. The filament may be formed here in such a way that the markings achieved therewith can be detected both capacitatively and visually and therefore measuring processes known from the measurement of yarns can be used. The method according to the invention can be used, in particular, also in conjunction with processes and devices for inspection of the products and in the process, for example even after weaving a woven fabric, can be used to reliably rediscover detected faults even after processing of the product web, although the detectability of the fault has changed in the meantime.

BRIEF DESCRIPTION OF THE DRAWINGS

The invention will be described hereinafter in more detail with the aid of an example and with reference to the accompanying drawings, in which.

DETAILED DESCRIPTION

Figure 1:
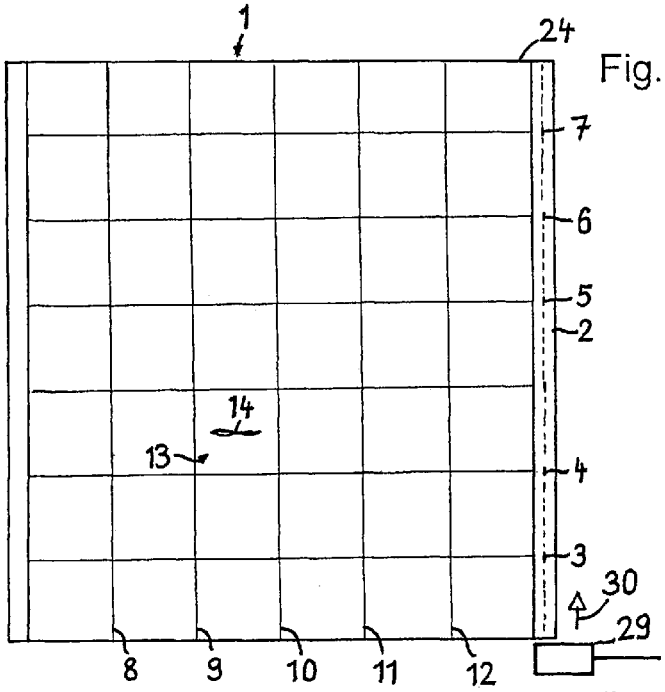
FIG. 1 is an illustration of a textile fabric.

FIG. 1 shows a portion 1 of a textile fabric, such as, for example, a woven fabric, with a so-called edge 2 on which markings 3, 4, 5, 6, 7 have been applied which are continued in imaginary lines in the transverse direction of the fabric 1. These markings 3 to 7 are achieved in that a warp thread is woven into a thread-like structure according to the invention. As a thread-like structure of this type can also be included as a weft thread, markings are produced, represented by lines 8, 9, 10, 11, 12, although in reality there are obviously no lines, but only markings on the edge of the relevant structure. Imaginary lines 8 to 12 of this type may usually also be defined by the mass of spacings, as the fabrics do not usually change their original size in the transverse direction and are usually cut according to their length. However, it cannot be assumed that the fabric is divided by the markings into a plurality of fields, such as for example field 13. As in this precise field 13 there is a fault 14, this fault can also subsequently be traced at any time, proceeding from the markings.

Figure 2:
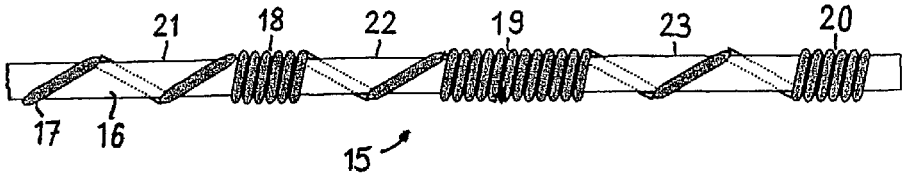
FIG. 2 is an illustration of a thread-like structure used therein.

FIG. 2 shows a thread-like structure 15 according to the invention, consisting of a support 16 and a filament 17 wound around the carrier 16. In the process, marking zones 18, 19, 20 are produced and, therebetween, marking-free zones 21, 22, 23 which can form markings 3 to 7 (FIG. 1) in the fabric 1. It can be seen that the number of windings of the filament 17 on the support 16 is substantially higher in the marking zones 18, 19, 20 than in the marking-free zones 21, 22, 23. In the marking zones 18, 19, 20, the windings of the filament 17 are located next to one another, practically without a gap.

Figure 3:
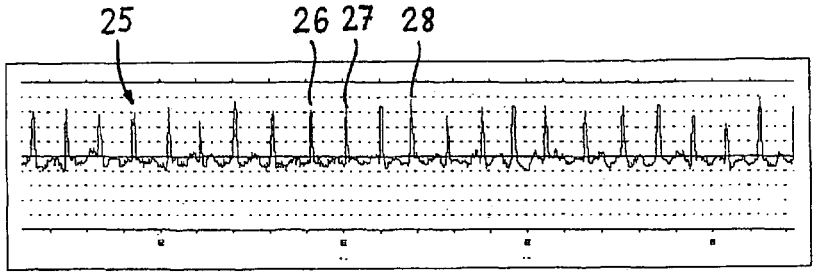
FIG. 3 is a signal course with markings.

FIG. 3 shows a signal course 25 with striking deviations 26, 27, 28 etc. as can be produced by the markings 3 to 7, etc. in the fabric 1 when the edge 2 traverses a suitable measuring apparatus such as, by way of example, a measuring capacitor.

The mode of operation of the invention is as follows:

Firstly, a thread-like structure 15 has to be produced according to the invention. For this purpose, a yarn or a twisted thread is taken, for example, as the support 16, comprising a diameter, such as the yarn or twisted thread also comprises in the fabric 1 to be marked. A wire with substantially smaller diameter is used as the filament 17, so it can easily be wound onto the yarn or twisted thread. Mentioned here as an example is a yarn with 30 tex as support and a copper lacquered wire of about 0.08 mm diameter as filament. The support 16 is preferably connected to the filament 17 in a fancy yarn doubling frame of known construction, the filament being processed as the fancy twisted thread is conventionally processed, but with the particular feature that the take-off speed of the support 16 is controlled in such a way that it is alternately fast and slow. During the high take-off speed, the marking-free zones 21, 22, 23 are produced with a very large pitch of the windings, and during the low take-off speed, the marking zones 18, 19, 20 are produced with very small pitch of the windings.

The thread-like structure 15 is then incorporated into the textile fabric 1 during production thereof. In the case of non-woven or knitted fabrics it is included. In woven fabrics it is woven in as warp thread approximately in the centre in the edge 2, or optionally included additionally in an end region 24 as a weft thread. Thus the fabric now has markings spanning a virtual matrix along lines 3 to 7 and 8 to 12 on the fabric.

The markings 3 to 7 on the fabric can now be scanned by means known per se, such as are known from yarn testing, in other words by optically or capacitatively working sensors 29 moved relative to the fabric 1 as shown by arrow 30. For visual scanning a coloured filament is desired and for capacitative scanning, a metal filament is desired. Particularly advantageous therefore, is a coloured metal wire, for example a so-called copper lacquered wire, i.e. a copper wire lacquered in colour on its surface. The markings now produce a characteristic signal course 25 (FIG. 3) with striking deviations 26 to 28 in a suitable sensor 29, these deviations 26 to 28 being fed to a processor which carries out a suitable evaluation, for example in that it numbers and stores consecutive deviations. The signals may then also be related to faults 14 on the fabric 1, so specific signals or numbers are then associated with the fault. These are, however, purely expert measures which can be carried out in the most varied ways and are therefore not shown in detail here, as they do not impinge on the core of the invention.

There are obviously also various possibilities of forming the markings with the filament; for example, an equal number of windings may always be provided in the marking zones or the number of windings may be graduated according to the criteria to be preset and markings may be applied to the thread-like structure, which markings are to be associated with various categories. However, it is also conceivable to construct a binary code by suitable selection of the numbers of windings, so each marking is unique in comparison to the other markings. Two filaments, for example with different diameter, can therefore be wound onto a support, thus forming main and secondary markings which bring about deviations with different amplitudes in the detected signal course.

What is claimed is:

1. A textile fabric having an edge region, and an indicator thread structure that extends along said fabric within said edge region, said indicator thread including a support thread around which a filament is wound with a varying pitch to thereby produce marking zones and marking-free zones, said marking zones being spaced so as to provide an indication of position along a dimension of said fabric.

2. The textile fabric of claim 1 wherein said indicator thread structure is woven into said edge region as a warp thread, and provides an indication of position along the length of said fabric.

3. The textile fabric of claim 1 wherein said indicator thread structure is woven into said edge region as a weft thread, and provides an indication of position across the width of said fabric.

4. The textile fabric of claim 1 wherein said indicator thread structure is woven into the center of said edge region.

5. The textile fabric of claim 1 wherein said marking zones form a binary code.

6. The textile fabric of claim 1 wherein different ones of said marking zones contain different respective numbers of windings of said filament, to provide different categories of indication.

* * * * *